US006640469B1

(12) United States Patent
McKenzie et al.

(10) Patent No.: US 6,640,469 B1
(45) Date of Patent: Nov. 4, 2003

(54) SNOW BLOWER VEHICLE AND METHOD FOR IMPROVING SNOW BLOWER VEHICLE PERFORMANCE

(75) Inventors: Ian Daniel McKenzie, Canton, MI (US); Jeffery Scott Hawkins, Farmington Hills, MI (US); David John Brunette, Royal Oak, MI (US); Richard Michael Avery, West Bloomfield, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/157,501

(22) Filed: May 29, 2002

(51) Int. Cl.[7] ..... E01H 6/00
(52) U.S. Cl. ..... 37/242; 37/197
(58) Field of Search ..... 37/196, 197, 219, 37/222, 231, 237, 238, 241, 242, 244; 123/339.16, 339.17, 339.18, 478, 585; 62/323.4; 180/69.3

(56) References Cited

U.S. PATENT DOCUMENTS 4,549,365 A * 10/1985 Johnson ..... 37/251
4,625,697 A 12/1986 Hosaka
4,721,083 A 1/1988 Hosaka
4,879,982 A 11/1989 Itakura et al.
5,010,863 A 4/1991 Ishida et al.
5,346,018 A * 9/1994 Koster ..... 172/47
5,718,200 A 2/1998 Chunjo et al.
5,802,745 A * 9/1998 Haseotes et al. ..... 37/234

OTHER PUBLICATIONS

Oshkosh H–Series Snow Blower Specifications, Oshkosh Truck Corporation, Oshkosh, WI, HS5019 595. No date.

* cited by examiner

*Primary Examiner*—Robert E. Pezzuto
(74) *Attorney, Agent, or Firm*—Brooks Kushman P.C.

(57) ABSTRACT

A snow blower, vehicle having a blower engine and a propulsion engine is provided with a drvice for limiting the speed of operation of the snow blower vehicle if the blower engine is overloaded. A first signal is transmitted to the propulsion engine when the blower engine is overloaded and a second signal is transmitted to the propulsion engine when the blower engine is no longer being overloaded. The first signal may be provided to the propulsion engine to automatically limit the output thereof or it may be provided to generate an operator perceptible warning to the operator of the vehicle. The second signal may be provided to the propulsion engine to discontinue the limitation of the output of the propulsion engine or to stop the generation of the warning. A method of improving snow blower performance by increasing the ability of the blower engine to blow snow by limiting the output of the propulsion engine.

11 Claims, 1 Drawing Sheet

SNOW BLOWER VEHICLE AND METHOD FOR IMPROVING SNOW BLOWER VEHICLE PERFORMANCE

BACKGROUND OF THE INVENTION

1. Field of the Invention

The present invention relates to snow blower vehicles having a propulsion engine and a separate snow blower engine and methods of coordinating the operation of the two engines for improved snow blower performance.

2. Background Art

Snow blower vehicles are large, specialized trucks that are used to remove snow from roads and parking lots. Such vehicles are primarily used in areas where heavy snow accumulations cannot be effectively plowed. Snow blower vehicles may have a diesel propulsion engine and a separate diesel engine for driving a hydraulic pump that is used to turn the auger of the snow blower mechanism. When the snow blower vehicle is operating on heavy snow accumulations, the snow blower can become packed with snow and the snow blower engine can be overloaded if the vehicle speed that is controlled by the propulsion engine exceeds the rate at which snow can be cleared by the snow blower.

Performance of the snow blower can be adversely affected if the snow blower auger becomes jammed with snow. If the auger becomes jammed, it may be necessary to clear the auger manually or at least stop the vehicle until the snow blower can clear the snow-blowing mechanism. Repeatedly overloading the snow blower engine can result in damage to the engine.

The above problems and disadvantages are addressed by the present invention as summarized below.

SUMMARY OF THE INVENTION

According to the present invention, a method and apparatus is provided for improving the performance of a snow blower vehicle by adjusting the performance of the vehicle's propulsion engine in response to an indication that the snow blower engine is overloaded.

According to one aspect of the invention, a snow blower vehicle is provided that includes a truck body on which a propulsion engine is secured for moving the snow blower vehicle. The propulsion engine includes an engine controller that controls the operation of the propulsion engine. A snow-blowing mechanism is also provided on the truck body. A blower engine is operatively connected to the snow-blowing mechanism. A first status signal is transmitted to the propulsion engine controller when the blower engine is being overloaded. A second status signal is transmitted to the propulsion engine controller when the blower engine is no longer being overloaded. When the propulsion engine controller receives the first status signal, the propulsion engine controller limits an output of the propulsion engine, such as speed or torque, until the second status signal is received or the propulsion engine is otherwise shut off. As such, coordinated operation takes place between the two separate engines for improved performance.

According to other aspects of the invention, the speed of the propulsion engine may be adjusted by the propulsion engine controller that may adjust a fueling rate parameter. The propulsion engine controller may also override an operator throttle control signal causing the vehicle to coast until a second status signal is received by the propulsion engine controller.

According to yet another aspect of the invention, a snow blower vehicle is provided that comprises a truck body from which a propulsion engine is provided for moving the snow blower vehicle. The propulsion engine has an engine controller that controls operation of the propulsion engine. A snow blowing mechanism is also provided on the truck body. A blower engine on the truck body is operatively connected to the snow blowing mechanism. A first status signal is transmitted to indicate that the blower engine is being overloaded. A second status signal is transmitted to indicate that the blower engine is not overloaded. When the first status signal is transmitted, a temporary limitation is imposed on the output of the propulsion engine. On the second output signal being transmitted after the temporary limitation is imposed on the output of the propulsion engine, the temporary limitation is then overridden.

According to other aspects of the invention, the first status signal may be used to generate an operator perceptible warning for instructing the operator to slow the speed of the snow blower vehicle until the second signal is transmitted. Alternatively, the first status signal may cause the operator throttle control to be disabled thereby causing the vehicle to coast until the second signal is transmitted.

According to another aspect of the method of the present invention, as applied to a snow blower vehicle having a propulsion engine and a snow blower engine where each engine has a controller, the method may be characterized as beginning with the step of determining that the snow blower engine is overloaded and generating a first signal. The first signal is then transmitted to the propulsion engine. In response, the operative propulsion engine is limited. It is next determined when the snow blower engine is no longer overloaded after the limiting strategy is implemented. A second signal is then transmitted to the propulsion engine reversing the step of limiting the propulsion engine. According to other aspects of the invention, the output limitation may be repeated to incrementally limit the output of the propulsion engine. Likewise, the second signal may be repeated to allow for incremental reduction of the limitation of the output of the propulsion engine.

These and other aspects of the invention will be understood by one of ordinary skill in the art in view of the attached drawings and following detailed description of the invention.

DETAILED DESCRIPTION OF THE PREFERRED EMBODIMENT(S)

Figure 1:
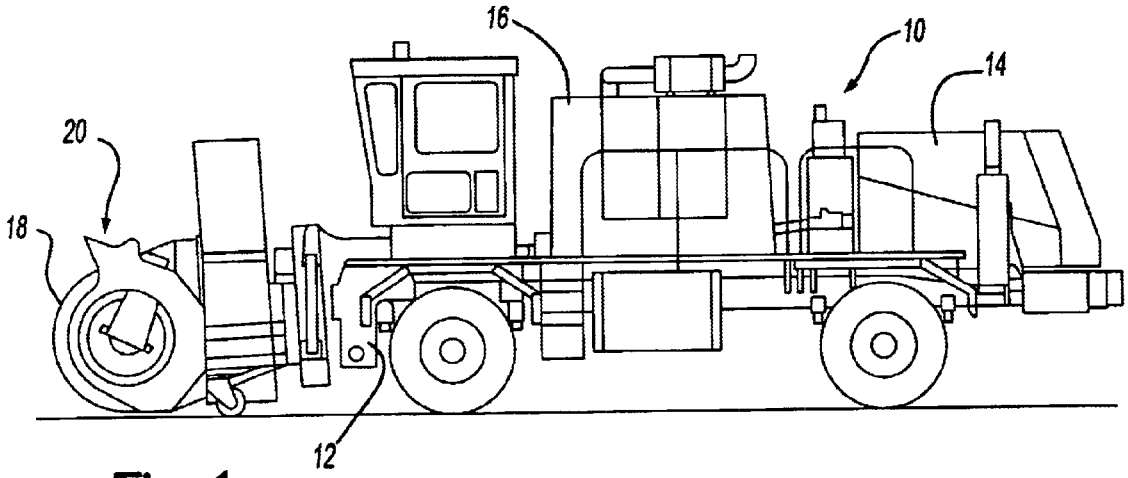
FIG. 1 is a side elevation view of a snow blower vehicle.

Referring now to FIG. 1, a snow blower vehicle is generally indicated by reference numeral 10. Snow blower vehicle 10 includes a chassis 12 on which a propulsion engine 14 is supported on one end. A blower engine 16 is provided in the center of the vehicle 10. A snow blower auger 18 is provided on the front end of the vehicle 10.

The blower engine 16 is connected by known means such as a hydraulic drive to the snow blower auger 18. The blower engine 16 is used to turn the snow blower auger 18 at a relatively high rate of speed so that the auger 18 may blow, or throw, snow generally to the side of the vehicle 10 through a snow throwing chute 20.

The snow blower vehicle 10 is driven by the propulsion engine 14. The propulsion engine 14 includes an engine controller (not shown) that controls operation of the propulsion engine. The propulsion engine controller can control the propulsion engine 14 to affect the speed at which the snow blower vehicle 10 is driven. The ability to control the speed of the snow blower vehicle 10 is critical for regulating the amount of snow delivered to the snow blower auger 18. For example, when the vehicle speed is at 40 mph, the amount of snow delivered to the snow blower auger 18 for a given period of time is twice as much as the amount of the snow delivered to the snow blower auger at 20 mph. At 40 mph the snow blower vehicle 10 covers twice as much area than it does at 20 mph, and therefore, sees twice as much snow. Accordingly, by controlling the speed of the snow blowing vehicle 14, the propulsion engine controller can regulate the amount of snow delivered to the snow blower auger 18. As such, when the snow blower auger 18 is being delivered more snow than it can effectively blow, i.e. when the blower engine 14 is overloaded, the propulsion engine controller can slow the speed of the snow blower vehicle 10 so that less snow is delivered to the snow blower auger 18 to lessen the load on the auger 18 for improving the performance of the snow blower vehicle 10 to effectively blow snow.

Similarly to the propulsion engine controller, the blower engine 16 includes a blower engine controller (not shown). The blower engine controller is used to manage the speed at which the snow blower auger 18 operates to blow the snow. The blower engine controller, like most engine controllers, can monitor operational parameters of the blower engine 16, like torque, speed, and load, as the snow is being blown. It should be noted, however, that the blower engine 16 parameters can also be measured by monitoring other components that have relationships with the engine torque, speed, and load or either devices that are separately attached to the blower engine 16, like an auger. The overload conditions are derived from these measurements. For example, before an overload condition is registered, the vehicle speed should be above a minimum speed threshold, such as 3 mph, the blower engine load should be at least at a maximum capacity for a minimum period of time, such as 5 seconds. Additionally, the blower engine speed should already have attained a speed sufficiently close to the desired engine speed and then subsequently the blower engine speed shall have decreased sufficiently lower than the desired blower engine speed for the blower at the current maximum capacity load. As one skilled in the art recognizes, these are exemplary conditions and any other conditions could also be included or excluded.

A first status signal is transmitted either by the blower engine controller or some other monitoring device to the propulsion engine controller when the blower engine 16 is overloaded. Receipt of the first status signal tells the propulsion engine controller the power output of the propulsion engine 14 needs to be decreased to slow the speed of the snow blower vehicle 10 for decreasing the amount of snow delivered to the snow blower auger 18. When less snow is delivered to the snow blower auger 18, the load on the blower engine 16 is lowered to improve the efficiency at which the snow is blown. The device that generated the first status signal can continue to monitor the blower engine 16. When the blower engine 16 is no longer being overloaded, the device transmits a second status signal to the propulsion engine 14 to indicate that the blower engine is no longer being overloaded. When the propulsion engine controller receives the second status signal, which can only be transmitted after the controller has received the first status signal, the propulsion engine controller discontinues the limiting of the output of the propulsion engine 14.

Propulsion engine 14 operation may be limited by adjusting engine control parameters such as engine fueling, timing, requested speed, or requested torque. The first and second signals may be based upon sensed conditions or parameters of the blower engine 16, such as, engine load, torque, or engine speed. If the blower engine parameters deviate from calibrated, or normal, requirements, the first signal may be provided to the propulsion engine to limit one or more of the above propulsion engine parameters to reduce the vehicle speed.

The engine parameters of the propulsion engine 14 may be continuously reduced until the blower engine parameters are brought back to within acceptable limits. When the blower engine 16 is no longer overloaded, the second signal may be provided to the propulsion engine 14 that will decrease the propulsion engine speed or torque limiting on an incremental basis. In both situations, either when the output of the propulsion engine 14 is being limited or the engine is being released from being limited, a hysterisis is calculated into the limiting to prevent chattering between limiting states and to provide smooth changes in both the severity of the limiting and the increments at which the limiting is applied to the propulsion engine 14.

If the snow blower vehicle 10 is driven at a speed where the blower engine 16 cannot keep up with the rate of snow intake, the blower engine 16 may become overloaded and begin to stall. When the blower engine 16 becomes overloaded, it may not throw the snow an appropriate distance or may clog the snow throwing chute 20. By adjusting the engine parameters of the propulsion engine 14 (for example by reducing the fuel rate or adjusting engine timing), the coordinating communication between the two separate engines reduces the load and returns the blower engine 16 to acceptable performance levels. The propulsion engine can be controlled in any number of ways, but the speed or torque limit function is prevented from reducing the engine speed or torque of the propulsion engine 14 below idle.

The propulsion engine 14 and blower engine 16 may be connected by means of a data link such as the J1587 or J1939 data link. The first signal can be a rpm signal such as the tachometer output. A pulse width modulated signal can be used to communicate the power train demand or engine torque within specified ranges. The system could also be used to light a visual indicator on the vehicle dashboard such as a "slow down" message light on the dashboard that would instruct the operator of the vehicle 10 to reduce the vehicle speed by down shifting or reducing the throttle angle. The system could also be used to override an operator throttle control signal and cause the snow blower vehicle 10 to coast until the second status signal is received.

Alternatively, torque limiting could be implemented with an alternate torque curve or digital torque limit curve for determining when the blower engine 16 is beginning to overload. In addition, either analog or digital signals could be transmitted between the blower engine controller and the propulsion engine controller to implement the invention.

Figure 2:
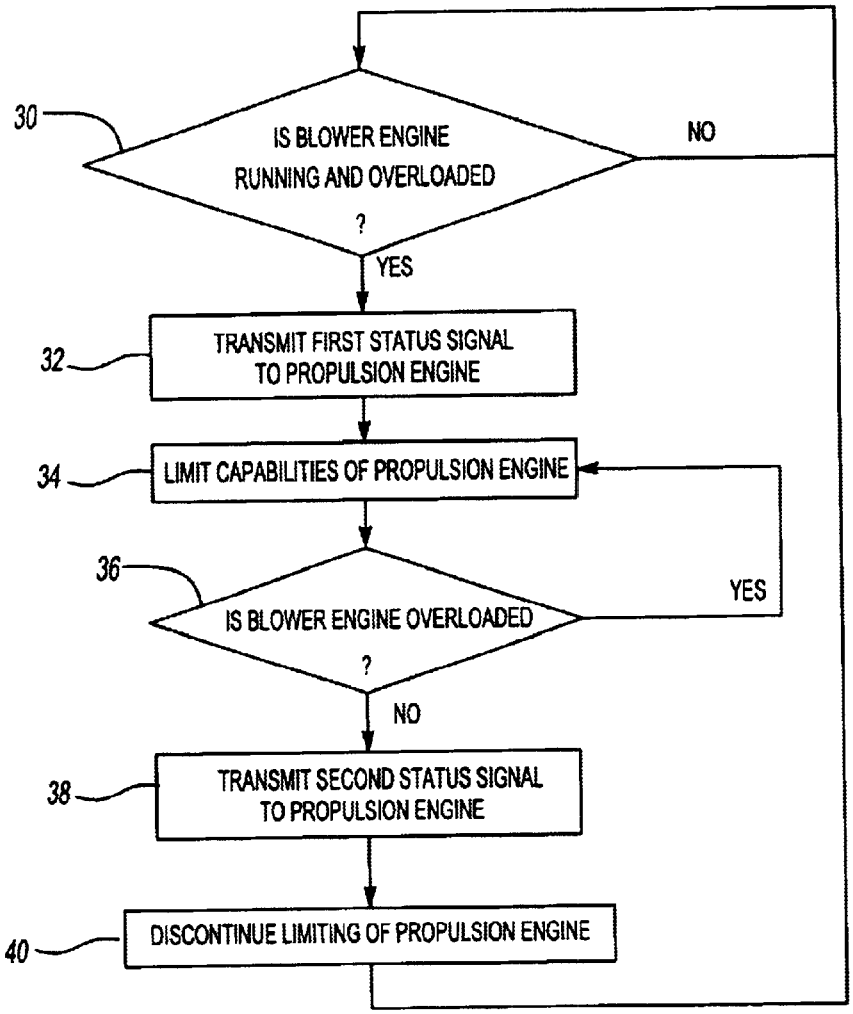
FIG. 2 is a flowchart illustrating an example of one set of logic steps that may be used to implement the method and apparatus for improving snow blower vehicle performance of the present invention.

FIG. 2 illustrates a flowchart which demonstrates a method for improving snow blower vehicle performance in accordance with the present invention. At block 30, the method includes a logic step for determining whether blower engine 16 is being overloaded. At step 32, a signal is sent to a propulsion engine control module to limit the power capabilities of the propulsion engine 14 if the blower engine 16 is overloaded. At step 34, the propulsion engine controller limits the power capability of the propulsion engine 14 until the propulsion engine controller receives a second status signal. At step 36, the blower engine 16 is monitored to determine if the blower engine 16 is overloaded. (In some cases it may be advantageous to change the severity of the limitation previously applied to the power output if the blower engine 16 is still overloaded.) At step 38, the second status signal is transmitted to the propulsion engine 14 to discontinue the limiting of the propulsion engine 14 if the blower engine 16 is no longer overloaded. At step 40, the limiting of the propulsion engine 14 is discontinued.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A snow blower vehicle comprising:

a truck body;

a propulsion engine on the truck body for moving the snow blower vehicle, the propulsion engine having an engine controller that controls the operation of the propulsion engine;

a snow blowing mechanism on the truck body;

a blower engine on the truck body that operatively connects the snow blowing mechanism to a signal generator that transmits a first status signal and a second status signal to the propulsion engine controller, wherein the first status signal is transmitted to the propulsion engine controller indicating that the blower engine is being overloaded and the second status signal is transmitted to the propulsion engine controller indicating that the blower engine is not overloaded; and wherein upon the first status signal being received by the engine controller of the propulsion engine the propulsion engine controller imposes a temporary limitation on the output of the propulsion engine, and upon the second output signal being received by the engine controller the propulsion engine controller discontinuing the limitation on the output of the propulsion engine.

2. The snow blower vehicle of claim 1 wherein the propulsion engine controller limits the output torque of the propulsion engine.

3. The snow blower vehicle of claim 1 wherein the propulsion engine controller limits the speed of the propulsion engine.

4. The snow blower vehicle of claim 3 wherein the speed of the propulsion engine is adjusted by the propulsion engine controller adjusting at least one of a fueling rate parameter, an engine timing parameter, and an exhaust gas recirculation parameter.

5. The snow blower vehicle of claim 1 wherein the propulsion engine controller overrides an operator throttle control signal thereby causing the vehicle to coast until the second signal is received by the propulsion engine controller.

6. A method of improving snow blower vehicle performance, the snow blower vehicle having a propulsion engine having a propulsion engine controller and a snow blower engine having a snow blower engine controller, comprising:

determining that the snow blower engine is overloaded and generating a first signal;

transmitting a first signal to the propulsion engine;

limiting the output of the propulsion engine in response to receiving the first signal;

determining that the snow blower engine is not overloaded after the first signal is received by the propulsion engine and generating a second signal;

transmitting the second signal to the propulsion engine; and reversing the step of limiting the propulsion engine upon the propulsion engine receiving the second signal.

7. The method of claim 6 wherein said steps of determining that the snow blower is overloaded, transmitting the first signal, and limiting the output of the propulsion engine may be repeated to incrementally limit the output of the propulsion engine.

8. The method of claim 6 wherein said steps of determining that the snow blower is not overloaded, transmitting the second signal, and reversing limiting the output of the propulsion engine may be repeated to incrementally reduce limiting the output of the propulsion engine.

9. A snow blower vehicle comprising:

a truck body;

a propulsion engine on the truck body for moving the snow blower vehicle, the propulsion engine having an engine controller that controls the operation of the propulsion engine;

a snow blowing mechanism on the truck body;

a blower engine on the truck body that is operatively connected to the snow blowing mechanism, a first status signal being transmitted to indicate that the blower engine is overloaded, a second status signal being transmitted to indicate that the blower engine is not overloaded; and wherein upon the first status signal being transmitted a temporary limitation is imposed on the output of the propulsion engine, and upon the second output signal being transmitted after the temporary limitation on the output of the propulsion engine is imposed causing the temporary limitation to be overridden.

10. The snow blower vehicle of claim 9 wherein the first status signal causes an operator perceptible warning to be generated to instruct an operator to slow the speed of the snow blower vehicle until the second signal is transmitted.

11. The snow blower vehicle of claim 9 wherein the first status signal causes the operator throttle control to be disabled, thereby causing the vehicle to coast until the second signal is transmitted.

* * * * *